US006266011B1

(12) United States Patent
Hong

(10) Patent No.: US 6,266,011 B1
(45) Date of Patent: Jul. 24, 2001

(54) ELECTRONICALLY SCANNED PHASED ARRAY ANTENNA SYSTEM AND METHOD WITH SCAN CONTROL INDEPENDENT OF RADIATING FREQUENCY

(75) Inventor: John H. Hong, Thousand Oaks, CA (US)

(73) Assignee: Rockwell Science Center, LLC, Thousand Oaks, CA (US)

( * ) Notice: Subject to any disclaimer, the term of this patent is extended or adjusted under 35 U.S.C. 154(b) by 0 days.

(21) Appl. No.: 09/409,965

(22) Filed: Sep. 30, 1999

(51) Int. Cl.[7] ..... H01Q 3/22
(52) U.S. Cl. ..... 342/375
(58) Field of Search ..... 342/375

(56) References Cited

U.S. PATENT DOCUMENTS

| | | | | |
|---|---|---|---|---|
| 3,646,558 | | 2/1972 | Campanella | 343/100 SA |
| 3,766,558 | * | 10/1973 | Kuechken | 342/375 |
| 4,117,487 | * | 9/1978 | Minohara et al. | 342/375 |
| 4,217,587 | | 8/1980 | Jacomini | 343/100 SA |
| 4,318,104 | | 3/1982 | Enein | 343/100 LE |
| 4,384,290 | | 5/1983 | Pierrot et al. | 343/6 A |
| 4,544,925 | | 10/1985 | Drabowitch et al. | 343/18 E |
| 4,725,844 | | 2/1988 | Goodwin et al. | 342/374 |
| 4,822,149 | | 4/1989 | Kubick | 350/389 |
| 4,931,803 | | 6/1990 | Shimko | 342/371 |
| 5,182,155 | | 1/1993 | Roe | 428/116 |
| 5,339,086 | | 8/1994 | DeLuca et al. | 342/371 |
| 5,475,392 | * | 12/1995 | Newberg et al. | 342/375 |
| 5,854,610 | | 12/1998 | Wojtowicz et al. | 342/372 |
| 5,926,134 | | 7/1999 | Pons et al. | 342/368 |
| 6,002,365 | * | 12/1999 | Page | 342/375 |

OTHER PUBLICATIONS

W.H. Huggins, "Generalized Radar Concepts with the use of Array Antennas", Rand Corp., Report RM1954, (Dec. 1956).

R. Benjamin et al., "Optical beam former for phased arrays with independent control of radiated frequency and phase", Electronics Letters, vol. 26, pp. 1853–1855 (Oct. 1990).

Skolnik, "The Electronically Directed Phased Array Antenna in Radar", *Introduction to Radar Systems*, Chapter 8, pp. 278–342, McGraw–Hill Publishing Co., (1980).

M. Li et al., "Novel low–cost beam–steering techniques using microstrip patch antenna arrays fed by dielectric image lines", IEEE Trans. Antennas Propagation, vol. 47, pp. 453–457, (Mar. 1999).

* cited by examiner

*Primary Examiner*—Gregory C. Issing
(74) *Attorney, Agent, or Firm*—Koppel & Jacobs

(57) ABSTRACT

A phased array antenna system and method employs a phase delay network to provide a scan angle control signal to respective mixers, with phase delays that correspond to the lengths of delay lines between antenna elements. The mixers are connected in circuit with their respective antenna elements so that the scan angle is controlled by the frequency of the scan control signal, independent of the operating signal frequency for the antenna elements. The system can be tailored for either beam transmission or reception, and is applicable to both single and dual delay network versions as well as multi-dimensional arrays.

12 Claims, 5 Drawing Sheets

ELECTRONICALLY SCANNED PHASED ARRAY ANTENNA SYSTEM AND METHOD WITH SCAN CONTROL INDEPENDENT OF RADIATING FREQUENCY

BACKGROUND OF THE INVENTION

1. Field of the Invention

This invention relates to electronically scanned phased array antennas.

2. Description of the Related Art

The antenna beams of conventional surveillance and communications radar and other communications systems have been mechanically rotated, electrically controlled by phased arrays using phase shifters, or driven by mechanically actuated phase shifters in an attempt to increase range. In the 1950's, phased array technology progressed from mechanical to electronic phase shifters with a phase shifter that used a fixed delay line sandwiched by two frequency mixers (W. H. Huggins, "Generalized Radar Concepts with the use of Array Antennas," Rand Corp., Report RM1854, December 1956). Similar techniques have been used in optical parallel-feed beam forming networks; R. Benjamin, C. D. Iaglanikis and A. J. Seeds, "Optical beam former for phased arrays with independent control of radiated frequency and phase," *Electronics Letters,* vol. 26, pages 1853–1855, October 1990. In the early 1960's, digitally switched phase shifters used ferrites or diodes.

Although phased array antennas using electronic phase shifters offered distinct advantages over mechanically actuated aperture antennas (i.e. a nearly flat radiating aperture amenable to conformal structures, an electronically scanned beam providing an inertialess steering system, a superior life expectancy, a more effectively synthesized beam pattern for which a number of known algorithms are applicable, and adaptability to hostile environments, including the presence of radar jammers), they were costly and difficult to manufacture for higher frequencies. Phase shifters also experienced temperature-sensitivity, hysteresis and quantization errors, and were limited to the microsecond phase shifting time range (Skolnik, *Introduction to Radar Systems,* Chapter 8, "The Electronically Directed Phased Array Antenna in Radar," pages 278–342, McGraw-Hill Publishing Co., 1980).

As an alternative to individual phase shifters, simple series-fed frequency-scan arrays have provided beam steering with virtually no phase shifter components except for fixed delay lines. See Skolnik, above, and M. Li, K. Chang, "Novel low-cost beam-steering techniques using microstrip patch antenna arrays fed by dielectric image lines," *IEEE Trans. Antennas Propagation,* vol. 47, pages 453–457, March 1999. However, in these systems the radiating frequency changes as the beam is scanned, whereas a constant radiating frequency is normally desired.

SUMMARY OF THE INVENTION

The present invention seeks to provide a phased array antenna system and method that avoids the disadvantages of phase shifters discussed above, is more cost effective and yet allows for beam scanning without changing the frequency of the radiated signal. This is accomplished with an array of frequency mixers that correspond to the antenna elements of an antenna array, and a phase delay network that provides a scan control signal to the mixers with the required phase delays between the antenna elements. The mixers are connected in circuit with their respective antenna elements so that the system's scan angle is controlled by the frequency of the scan control signal, independent of the operating signal frequency for the antenna elements.

The phase delay network is preferably implemented with a time delay network, with the signal mixers tapping the time delay network at locations which correspond to the locations of their respective antenna elements. To transmit, a common mixing signal is mixed with each of the phase delayed scan control signals to yield progressively phase delayed transmission signals at a desired operating frequency, which are radiated by the antenna elements. In a receive mode the inputs from the antenna elements are mixed with their respective phase delayed scan control signals to yield mixer outputs with a frequency that is a function of both the scan control and operating signal frequencies. These outputs are accumulated and mixed with the scan control signal to yield the original operating signal. Appropriate filters are employed in both the transmit and receive modes to remove extraneous signals.

The invention can also be implemented with dual time delay networks. In the transmit mode the scan control signal and its complement, whose frequencies add up to the operating signal frequency, are counter-propagated through respective delay networks, from which they are tapped and mixed together at each of the mixers to yield the operating signal with appropriate phase delays for the various antenna elements. In a receive mode, scan control signal is tapped from one of the time delay networks and mixed with the incoming signals from the antenna elements, yielding outputs that are tapped into the other delay network to produce an output from which the operating signal can be extracted.

The invention is applicable to both single array antennas and, with appropriate phase offsets between them, multi-dimensional arrays.

These and other features and advantages of the invention will be apparent to those skilled in the art from the following detailed description, taken together with the accompanying drawings.

DETAILED DESCRIPTION OF THE INVENTION

Figure 1:
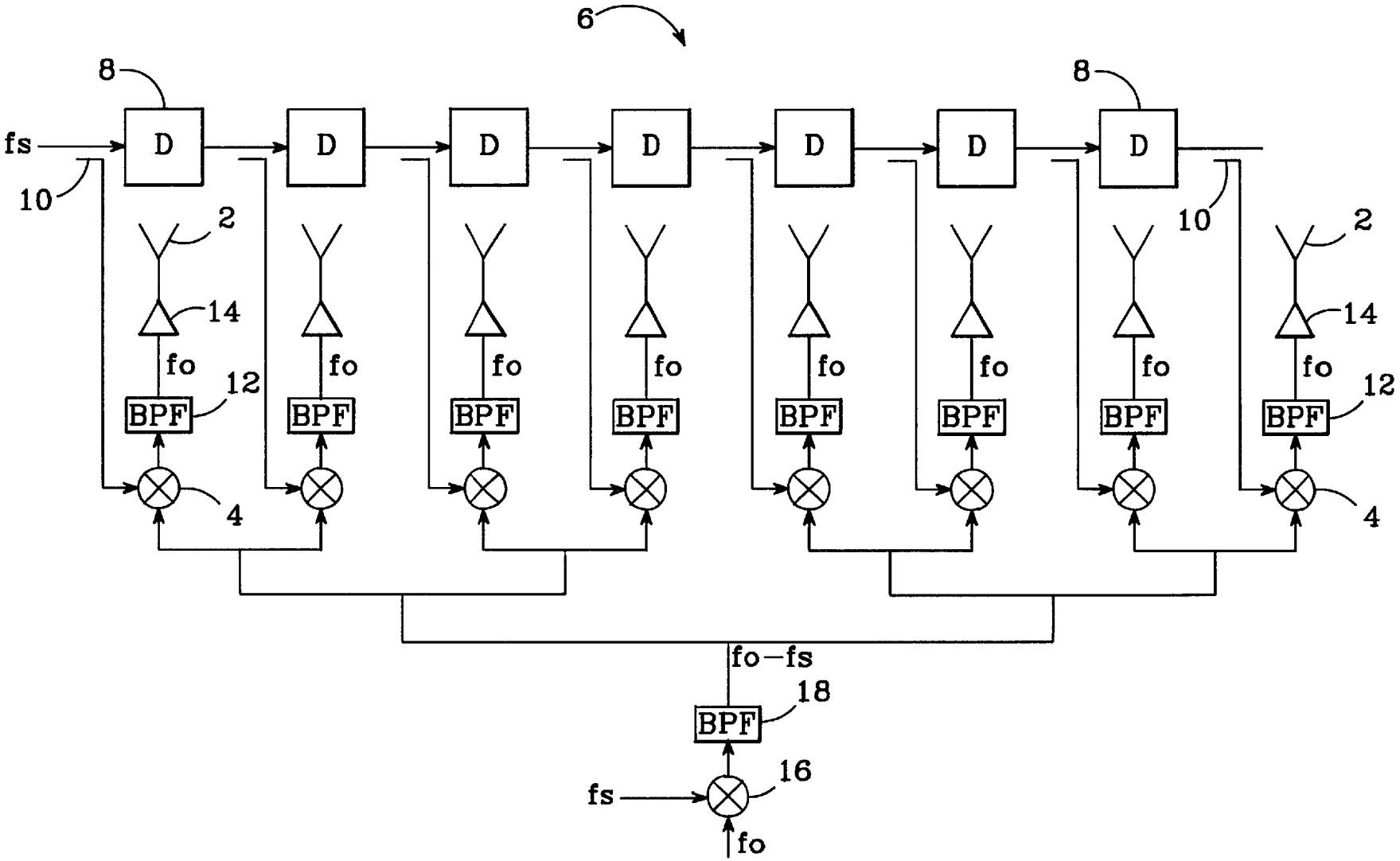
FIGS. 1 and 2 are block diagrams of a single delay line embodiment of the invention in transmit and receive modes, respectively.

FIG. 1 illustrates a heterodyne-scanned phased array antenna system in accordance with the invention, set up in a transmit mode. It includes an array of antenna elements 2 and an array of solid-state mixers 4, with each mixer associated with a corresponding antenna element. A delay network 6 includes a series of delay segments 8 which are tapped at intervals corresponding to the antenna element location by power couplers 10 that provide inputs into their respective mixers 4. A scan control signal having a frequency fs, which can be provided by a direct digital synthesizer, is propagated along the delay line, producing a phase delay between successive tap points that varies with fs. As fs increases, the electrical length between successive tap points will increase, and accordingly greater phase shifts.

Conversely, reducing fs reduces the phase shift between tap points. As described below, the amount of phase shift controls the scan angle of the beam radiated from the antenna elements. In general, the scan or pointing angle (relative to a perpendicular to the plane of the antenna array) is given by the expression $-\sin^{-1}(\delta\lambda_o/2\pi d)$, where $\delta$ is the relative phase shift applied between successive antenna elements, d is the antenna spacing and $\lambda_o$ is the wavelength that corresponds to the center frequency, fo.

The antenna elements radiate at a center carrier frequency fo, which can be selected for either radar or other communications applications. To provide the signal to the antenna elements, a mixing complement of fs is applied to the other input port of mixers 4 to yield fo as one of its outputs. In the illustration of FIG. 1, the mixing complement signal has a frequency fo-fs. When mixed with fs, this yields a number of output signal frequencies including the sum, difference and multiples of the mixed frequencies. Signal frequencies other than fo are removed from the mixer output by bandpass filters 12. The resulting fo signals are processed through amplifiers 14 and radiated from their respective antenna elements 2.

The fo-fs mixing complement can be obtained by mixing fo and fs in an additional mixer 16, and filtering the output in a bandpass filter 18 which is centered on fo-fs. This signal is applied in common to each of the array mixers 4, The element-to-element delay experienced by the scan control frequency fs provides the phasing effect necessary to point the array beam in desired directions. The element-to-element delay is fixed, but the drive frequency fs is variable so that the antenna's pointing angle can be linearly controlled by varying the frequency of the synthesizer used to produce fs. At a 10 GHz center frequency with an array spacing of 0.49 wavelength (which is slightly less than the usual half-wavelength spacing to preclude the appearance of grating lobes for extreme angle scanning), the required phase variance for a horizon-to-horizon scanning for each element is $\pm 0.98\pi$. If dt is the total fixed delay from one antenna element to the next, then the total phase delay at a scan control frequency of fs is $2\pi$ (fs)(dt).

Although the array spacing in this example is 0.49 wavelength, larger delays can be realized by using a combination of meandering transmission lines for the delay segments 8, coupled with a high dielectric constant material for the delay lines network substrate. For example, a Duroid RT6010 substrate will have a dielectric constant of 10.2, which gives a factor of 3.194 increase in the relative time delay from element to element compared to a free space propagation value. Artificial dielectrics involving the use of conductors embedded in low loss dielectrics can further reduce the phase velocity and thus increase the time delay. Increases can also be achieved by physically lengthening the delay lines in serpentine fashion. In general, if the delay length is L wavelengths, then the required frequency scanning range is fo/L.

The frequency range for fs can also be selected to reduce the delay line length and thus the circuit size. In one example, the radiation frequency and the delay line length were chosen to be 9.3 GHz and 2.24 wavelengths, with an fs frequency band of 15.1–18.1 GHz.

The signals radiated from each of the antenna elements 2 will be delayed in phase from element-to-element by the phase delays established by delay line segments 8. This allows the radiated beam angle to be scanned by varying fs, while the operating frequency fo remains constant. Thus, control over the scan angle is made independent of the operating frequency, which is a highly desirable characteristic.

Figure 2:
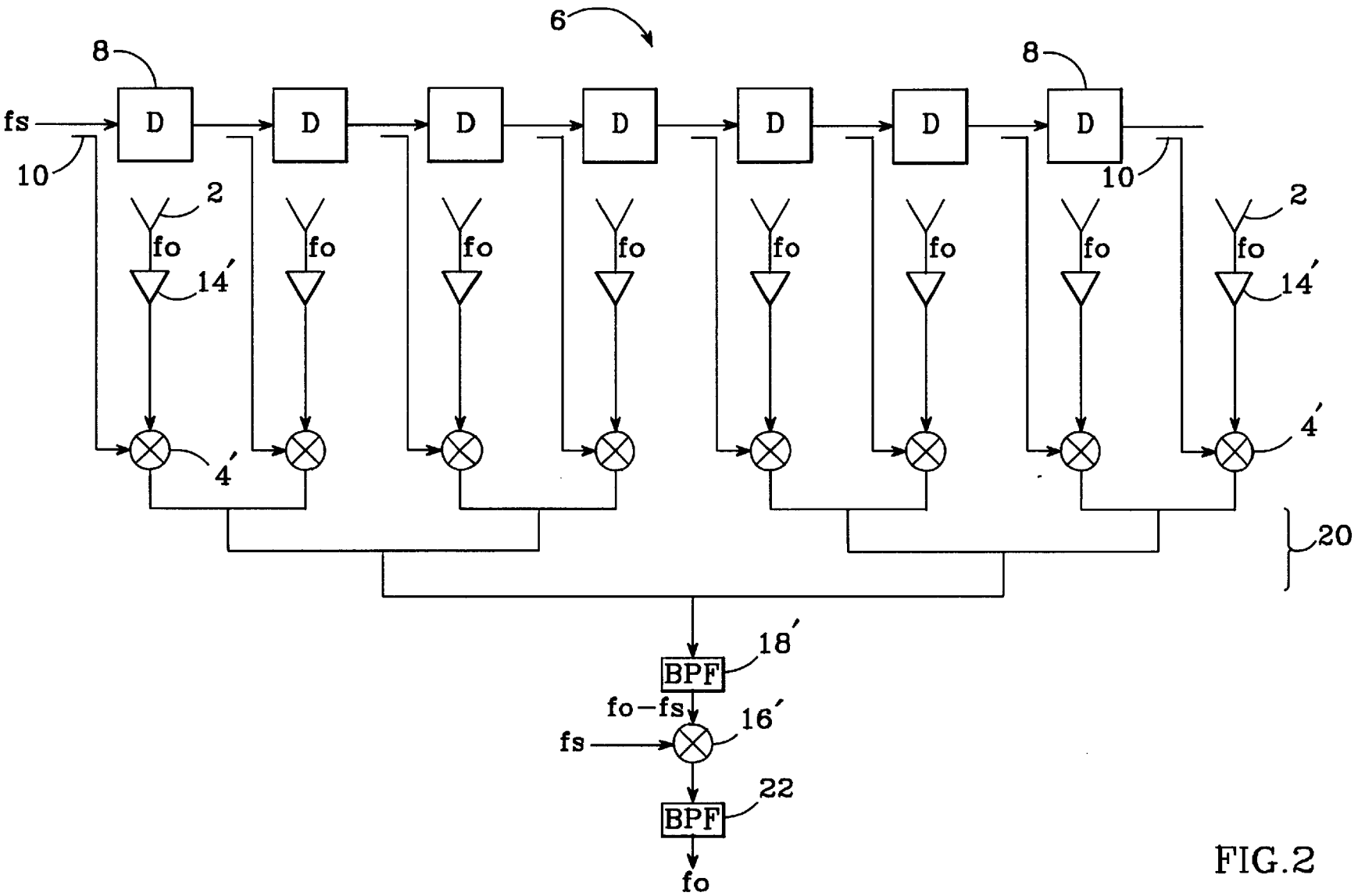

A similar system set up in a receive mode is illustrated in FIG. 2, in which elements that are common to FIG. 1 are indicated by the same reference numbers; a prime after a reference number indicates an element that is similar to one shown in FIG. 1 but is oriented in the opposite direction. A beam signal received by the antenna elements 2 is processed through respective amplifiers 14' and then applied to respective inputs of mixers 4', which also tap the delay line to receive delayed fs inputs as in the transmit mode. The mixer outputs are accumulated together without further phase delay by an accumulation network 20, with the resulting accumulated signal processed through a bandpass filter 18' that yields the fo-fs frequency outputed by the mixers. This signal is then mixed with fs in mixer 16', and the result is processed through a bandpass filter 22 to yield the desired operating signal fo.

As in the transmit mode, the scan control frequency fs controls the pointing angle of the antenna array for beam reception. The successively phase delayed scan control signals tapped from the delay line 6 will mix successfully only with in-phase components of the signals received by the various antenna elements. This forces the system to be sensitive only to received beam signals that have an element-to-element phase differential corresponding to the scan control phase differentials, or in other words to a desired beam steering angle for a given value of fs.

Figure 3:
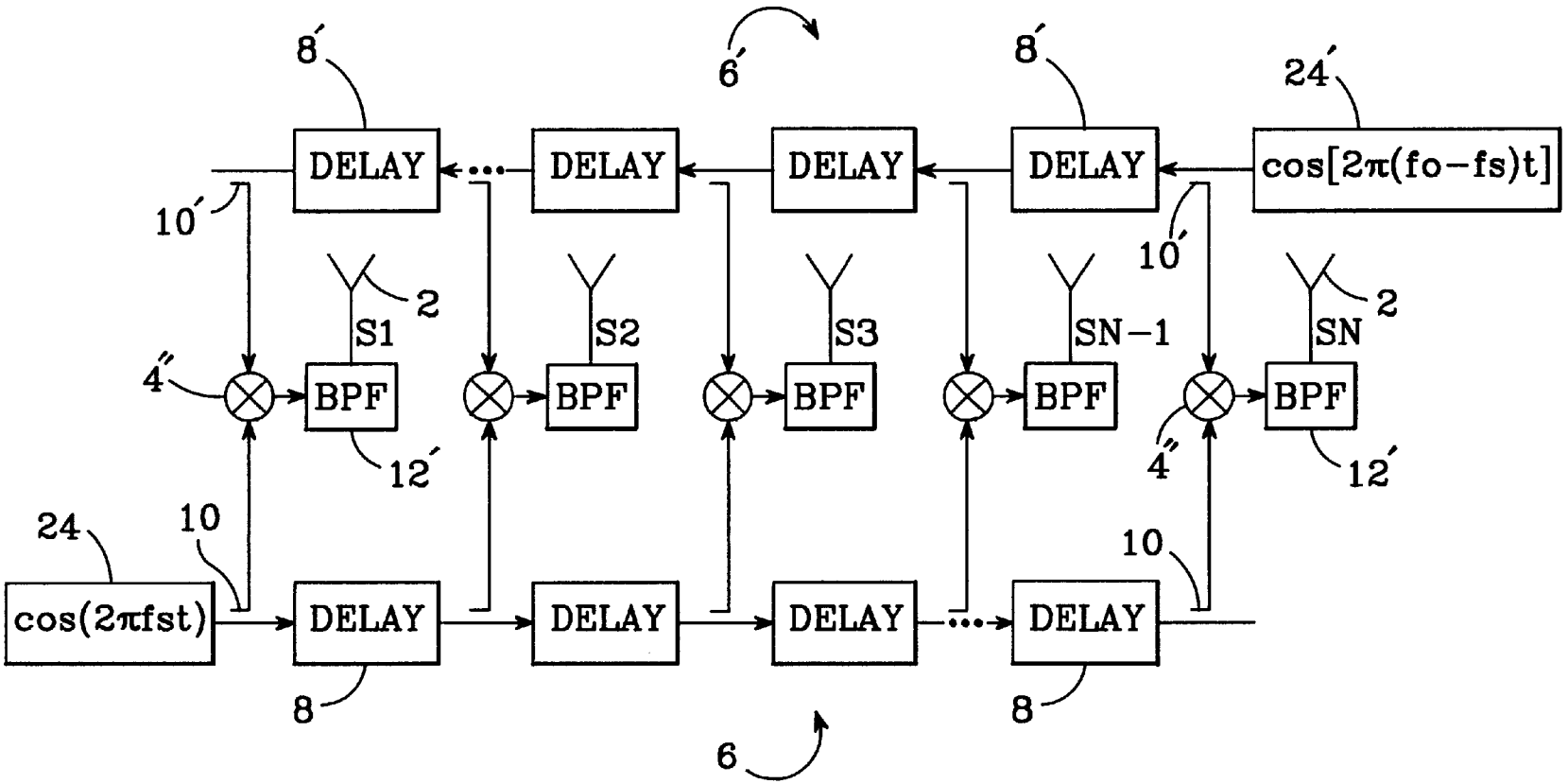
FIGS. 3 and 4 are block diagrams of a dual delay line embodiment of the invention in transmit and receive modes, respectively.

Another embodiment of the invention is shown in FIG. 3. This embodiment, shown in the transmit mode, employs dual delay lines which are fed with counterpropagating signals that, when tapped from the delay lines and mixed together, yield the desired operating signal with phase delays between successive antenna elements again controlled by the scan control frequency fs independent of the operating signal frequency.

The first delay line 6, consisting of N delay segments 8, is fed by a frequency synthesizer 24 that produces an output in the form $\cos(2\pi fst)$, which as illustrated in the figure propagates down the delay line 6 from left to right. A similar delay line 6' includes similar delay segments 8' and is fed by a signal from another frequency synthesizer 24', which produces an output having the form $\cos[2\pi(fo\text{-}fs)t]$. This signal counter propagates along delay line 6', from right to left. By tapping the delay line 6 with power couplers 10 and delay line 6' with power couplers 10' between adjacent delay segments, and mixing the tapped signals together in mixers 4", mixer outputs are produced that when filtered by bandpass filters 12' yield signals S1, S2, S3, . . . , SN-1, SN that are applied to respective antenna elements 2 to be radiated. SN, the extracted carrier frequency component for the Nth array element, has the form $\cos[2\pi fot+\phi o+2\pi(fo\text{-}2fs)N\tau]$, where t is time, $\phi o$ is an initial phase shift and $\tau$ represents the time delay of each delay line segment. SN thus has the desired operating frequency fo and a linear phase term that is proportional to the delay segment number N.

Figure 4:
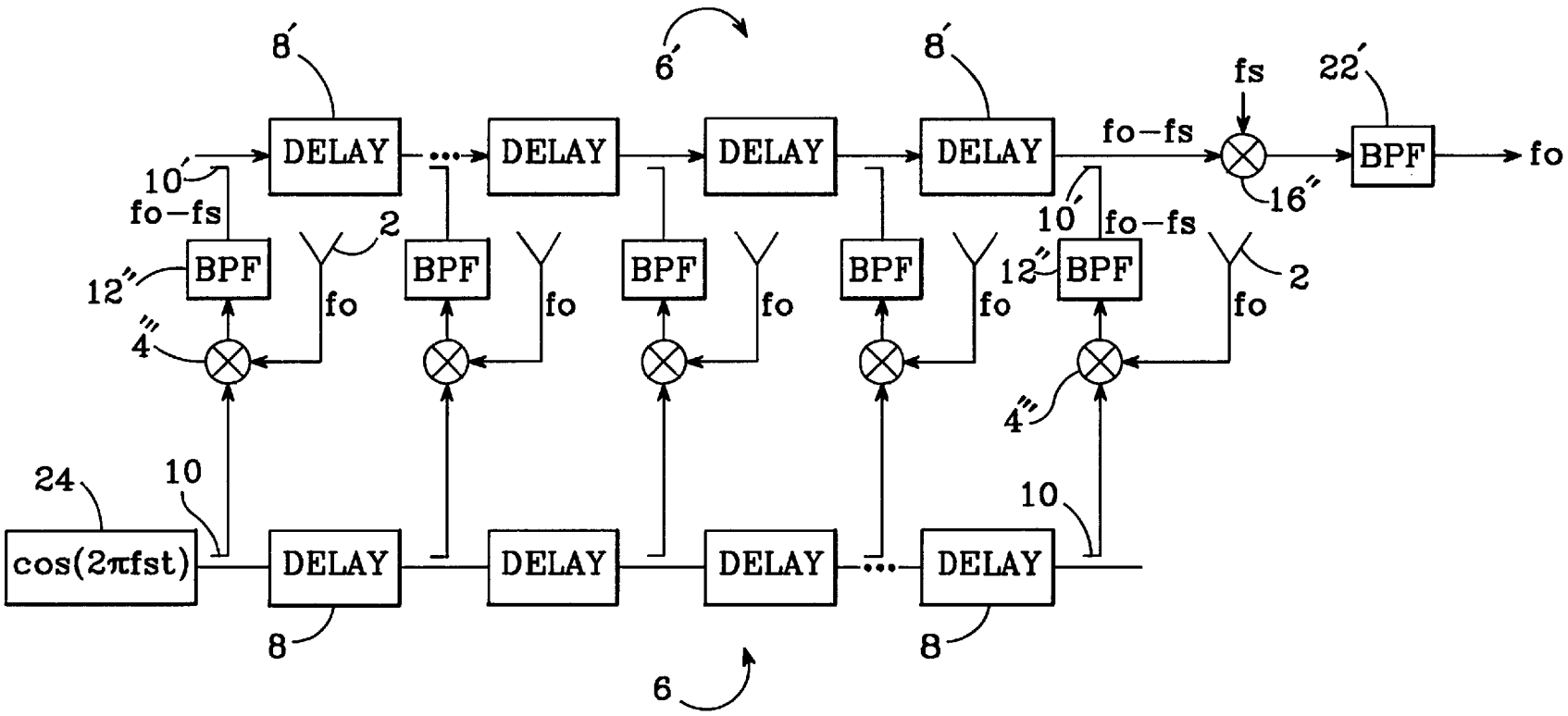

A similar system for a receive mode is illustrated in FIG. 4, with the same dual delay lines 6 and 6' and the same scan control signal $\cos(2\pi fst)$ propagated from left to right down delay line 6.

In the receive mode, the portions of the receive signal fo from antenna elements 2 that are in-phase with their respective phase delayed scan control signals are mixed with the scan control signals in mixers 4"', with the outputs processed through bandpass filters 12"to yield filtered signals having a frequency fo-fs. These signals are coupled to corresponding locations in the delay line 6' via power couplers 10' and sum together from left to right, yielding an accumulated output from the right most delay segment 8' with a frequency fo-fs. This signal is mixed with fs in mixer 16" and then filtered in bandpass filter 22' to yield a signal at the operating frequency fo. This output represents the signal received by the antenna elements at the desired steering angle, corresponding to the set scan control frequency fs.

Figure 5:
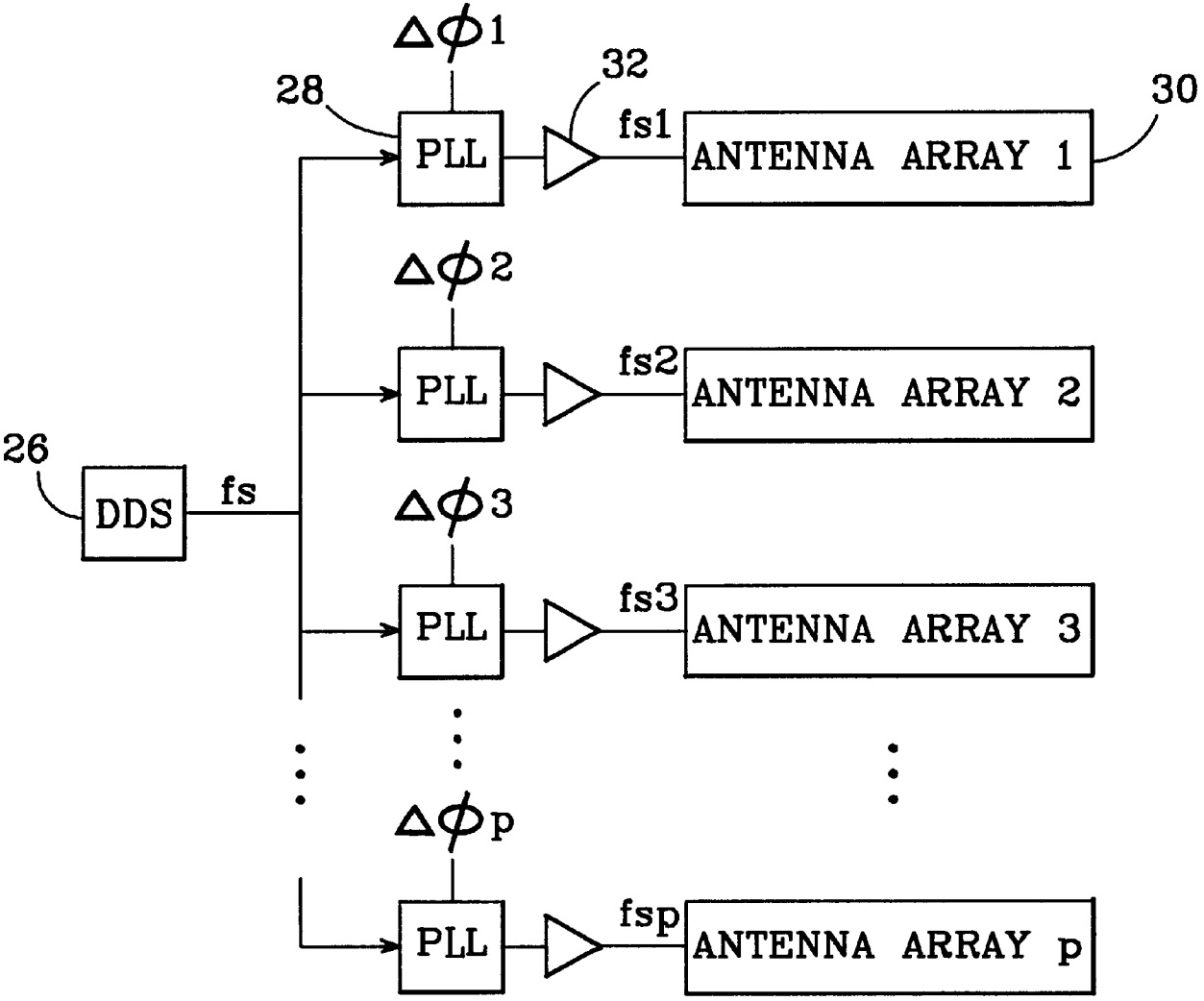
FIG. 5 is a block diagram of a multi-dimensional embodiment.

Two or three-dimensional arrays can be implemented by stacking rows of one-dimensional arrays and properly phasing the scan control frequency component to each row. This is illustrated in FIG. 5, in which a master oscillator such as a direct digital synthesizer 26 drives an array of slave oscillators, such as phase locked loops (PLLs) 28 with a desired scan control frequency fs. Each PLL is biased with a phase offset which can be digitally controlled to impart a unique phase for each row 30. The phase offsets $\Delta\phi\mathbf{1}$, $\Delta\phi\mathbf{2}$, $\Delta\phi\mathbf{3}$, . . . , $\Delta\phi$P(for P rows of antenna arrays) are selected to account for differences in the physical locations of the antenna arrays, so that all of the arrays point in the same desired scan direction. The slave oscillators apply their respective output scan control signals fs1, fs2, fs3, . . . , fsP to their respective antenna array rows via respective amplifiers 32.

The antenna arrays can be either linear or curved. The invention is applicable to arrays with upwards of 128×128 antenna elements, with each element approaching an isotropic radiation pattern into one hemisphere.

The invention provides an improved beam pointing control as well as cost reductions through the avoidance of expensive phase shifters. While specific embodiments of the invention have been shown and described, numerous variations and alternate embodiments will occur to those skilled in the art. Accordingly, it is intended that the invention be limited only in terms of the appended claims.

I claim:

1. A phased array antenna system, comprising:

an array of antenna elements, an array of frequency mixers corresponding to said antenna elements, and a fixed phase delay network connected to provide a scan control signal to said mixers with respective phase delays that correspond to delay line lengths between said antenna elements, said mixers connected in circuit with their respective antenna elements so that the scan angle of said antenna system is controlled by the frequency of said scan control signal independent of the frequency of an operating signal for said antenna elements, said phase delay network comprising a first time delay network between said antenna elements through which said scan control signal is propagated in a transmission mode in one direction, and a second time delay network between said antenna elements through which a mixing complement of said scan control signal is propagated in the opposite direction, said mixers connected to respective tap locations on said first and second time delay networks that correspond to said antenna elements, said mixers mixing said scan control signal and its mixing complement together to yield said operating signal as mixing outputs to said antenna elements.

2. The system of claim 1, said mixers connected in a receive mode to receive inputs from their respective antenna elements for mixing with their respective phase delayed scan control signals.

3. The system of claim 2, said mixers outputting signals with a frequency that is a function of the frequencies of both said scan control signal and said operating signal.

4. A method of operating a phased array of antenna elements, comprising:

providing said antenna elements with an operating signal at an operating frequency, establishing phase differentials between successive antenna elements as a function of the frequency of a scan control signal to establish a corresponding scan angle for said array, and varying the frequency of said scan control signal to vary said phase differential and thereby the array scan angle, while maintaining the frequency of said operating signal substantially constant, wherein said scan control signal is propagated in a transmission mode in one direction through a first time delay network between said antenna elements, a mixing complement of said scan control signal is propagated in the opposite direction through a second time delay network between said antenna elements, and said scan control signal and its mixing complement are mixed together from tap locations on said first and second time delay networks that correspond to said antenna elements to yield said operating signal as mixing outputs to said antenna elements.

5. The method of claim 4, wherein said mixing complement is generated by mixing said operating signal with said scan control signal.

6. A method of operating a phased array of antenna elements, comprising:

providing said antenna elements with an operating signal at an operating frequency, establishing phase differentials between successive antenna elements as a function of the frequency of a scan control signal, by propagating a scan control signal through a time delay network between successive antenna elements, to establish a corresponding scan angle for said array, and varying the frequency of said scan control signal to vary said phase differential and thereby the array scan angle, while maintaining the frequency of said operating signal substantially constant, wherein said scan control signal is propagate in a transmission mode in one direction through a first time delay network between said antenna elements, a mixing complement of said scan control signal is propagated in the opposite direction through a second time delay network between said antenna elements, and said scan control signal and its mixing complement are mixed together from tap locations on said first and second time delay networks that correspond to said antenna elements to yield said operating signal as mixing outputs to said antenna elements.

7. The method of claim 6, wherein said scan control signal is propagated in a receive mode in one direction through a first time delay network between said antenna elements, an operating signal is received by said antenna elements and mixed with said scan control signal at tap locations on said first time delay network corresponding to said antenna elements to yield the mixing complements of said scan control signal as mixing outputs, said mixing complements are tapped into and propagated in the same direction through a second time delay network, and said operating signal is sensed from the output of said second time delay network.

8. The method of claim 6, wherein said mixing complement is generated by mixing said operating signal with said scan control signal.

9. A method of operating a phased array of antenna elements, comprising:

providing said antenna elements with an operating signal at an operating frequency, establishing phase differentials between successive antenna elements as a function of the frequency of a scan control signal, by propagating a scan control signal through a time delay network between successive antenna elements, to establish a corresponding scan angle for said array, and varying the frequency of said scan control signal to vary said phase differential and thereby the array scan angle, while maintaining the frequency of said operating signal substantially constant, wherein said scan control signal is propagated in a receive mode in one direction through a first time delay network between said antenna elements, an operating signal is received by said antenna elements and mixed with said scan control signal at tap locations on said first time delay network corresponding to said antenna elements to yield the mixing complements of said scan control signal as mixing outputs, said mixing complements are tapped into and propagated in the same direction through a second time delay network, and said operating signal is sensed from the output of said second time delay network.

10. The method of claim 9, wherein said scan control signal is propagated in a transmission mode in one direction through a first time delay network between said antenna elements, a mixing complement of said scan control signal is propagated in the opposite direction through a second time delay network between said antenna elements, and said scan control signal and its mixing complement are mixed together from tap locations on said first and second time delay networks that correspond to said antenna elements to yield said operating signal as mixing outputs to said antenna elements.

11. A phased array antenna system, comprising:

an array of antenna elements, an array of frequency mixers corresponding to said antenna elements, and a fixed phase delay network connected to provide a scan control signal to said mixers with respective phase delays that correspond to delay line lengths between said antenna elements, said mixers connected in circuit with their respective antenna elements so that the scan angle of said antenna system is controlled by the frequency of said scan control signal independent of the frequency of an operating signal for said antenna elements, said phase delay network comprising a first time delay network between said antenna elements through which said scan control signal is propagated in a receive mode in one direction, and a second time delay network, said mixers mixing an operating signal received by said antenna elements with said scan control signal at tap locations on said first time delay network corresponding to said antenna elements to yield the mixing complements of said scan control signal as mixing outputs, said second time delay network being tapped to receive said mixing complements and propagate them in the same direction, said second time delay network providing an output from which said operating signal can be sensed.

12. A method of operating a phased array of antenna elements, comprising:

providing said antenna elements with an operating signal at an operating frequency, establishing phase differentials between successive antenna elements as a function of the frequency of a scan control signal to establish a corresponding scan angle for said array, and varying the frequency of said scan control signal to vary said phase differential and thereby the array scan angle, while maintaining the frequency of said operating signal substantially constant, wherein said scan control signal is propagated in a receive mode in one direction through a first time delay network between said antenna elements, an operating signal is received by said antenna elements and mixed with said scan control signal at tap locations on said first time delay network corresponding to said antenna elements to yield the mixing complements of said scan control signal as mixing outputs, said mixing complements are tapped into and propagated in the same direction through a second time delay network, and said operating signal is sensed from the output of said second time delay network.

* * * * *